US012201164B1

(12) United States Patent
Coates

(10) Patent No.: US 12,201,164 B1
(45) Date of Patent: Jan. 21, 2025

(54) SYSTEM FOR MAINTAINING AN INFANT IN A SUPINE POSITION

(71) Applicant: Tailored Technologies, Inc., Winston-Salem, NC (US)

(72) Inventor: Fredrica V. Coates, Winston-Salem, NC (US)

(73) Assignee: Tailored Technologies, Inc., Winston-Salem, NC (US)

( * ) Notice: Subject to any disclaimer, the term of this patent is extended or adjusted under 35 U.S.C. 154(b) by 0 days.

(21) Appl. No.: 18/899,874

(22) Filed: Sep. 27, 2024

Related U.S. Application Data

(60) Provisional application No. 63/544,350, filed on Oct. 16, 2023.

(51) Int. Cl.

| | |
|---|---|
| ***A41B 13/06*** | (2006.01) |
| ***A47D 15/00*** | (2006.01) |
| ***A47G 9/02*** | (2006.01) |
| ***A47G 9/04*** | (2006.01) |

(52) U.S. Cl.
CPC ..... *A41B 13/06* (2013.01); *A41B 13/065* (2013.01); *A47D 15/008* (2013.01); *A47G 9/0246* (2013.01); *A47G 9/04* (2013.01); *A47D 15/005* (2013.01); *A47G 9/0238* (2013.01)

(58) Field of Classification Search
CPC ..... A41B 13/06; A41B 13/065; A41B 13/00; A47G 9/0246; A47G 9/0238; A47G 9/04; A47G 9/02; A47G 9/08; A47G 9/083; A47D 15/005; A47D 15/008; A47D 15/02
USPC ... 5/603, 655, 652, 494, 496, 498, 500, 502, 5/923; 2/69.5, 69; 128/872, 873
See application file for complete search history.

(56) References Cited

U.S. PATENT DOCUMENTS

| | | | | |
|---|---|---|---|---|
| 4,858,625 | A * | 8/1989 | Cramer | A61F 5/3784 128/872 |
| 4,862,535 | A * | 9/1989 | Roberts | A47D 15/008 604/386 |
| 5,416,938 | A * | 5/1995 | Li | A47G 9/04 5/494 |
| 5,494,052 | A * | 2/1996 | Grohman | A61F 5/3769 128/876 |
| 5,890,769 | A * | 4/1999 | Fairbanks | A47D 15/006 297/DIG. 6 |
| 6,381,785 | B1 * | 5/2002 | Mancera Browne | A61F 5/37 5/655 |
| 6,817,048 | B1 * | 11/2004 | LaRosa | A47D 15/008 5/655 |
| 6,834,405 | B1 * | 12/2004 | Hillstead | A47D 15/008 5/655 |
| 7,111,344 | B2 * | 9/2006 | French | A41B 13/06 5/413 R |

(Continued)

*Primary Examiner* — Robert G Santos
(74) *Attorney, Agent, or Firm* — Suiter Swantz IP

(57) ABSTRACT

A system for maintaining an infant in a supine position on a base encased by a fitted cover. The system includes a garment including lateral tabs configured to removably attach to spaced tethers attached to the fitted cover. In use, the garment is positioned between the spaced tethers and each tether removably attaches to both sides of the respective tab such that the tab is captured between portions of the tether. In embodiments, the tabs and tethers removably attach using hook and look fasteners having a high resistance to shear pulling forces. In embodiments, the system resists rollover motion without constraining hip motion.

17 Claims, 9 Drawing Sheets

(56) References Cited

U.S. PATENT DOCUMENTS

| | | | | |
|---|---|---|---|---|
| 7,370,377 | B2 * | 5/2008 | Landry | A47D 15/008 5/500 |
| 8,020,226 | B2 * | 9/2011 | Landry | A47D 15/008 5/500 |
| 8,117,698 | B1 * | 2/2012 | Khaze Harry | A47D 5/00 5/655 |
| 8,191,188 | B2 * | 6/2012 | Kaplan | A47D 15/008 5/655 |
| 2002/0108176 | A1 * | 8/2002 | Ragen | A47D 13/08 2/69.5 |
| 2004/0199999 | A1 * | 10/2004 | Landry | A47D 15/008 5/494 |
| 2005/0210585 | A1 * | 9/2005 | French | A41B 13/06 2/69.5 |
| 2009/0113630 | A1 * | 5/2009 | Landry | A47D 15/02 5/500 |
| 2010/0242173 | A1 * | 9/2010 | Landry | A47D 15/008 5/494 |
| 2010/0275373 | A1 * | 11/2010 | Kaplan | A41B 13/06 5/494 |

* cited by examiner

SYSTEM FOR MAINTAINING AN INFANT IN A SUPINE POSITION

CROSS REFERENCE TO RELATED APPLICATION

This nonprovisional application claims the benefit of priority of U.S. Provisional Application No. 63/544,350 filed Oct. 16, 2023 for SYSTEM FOR MAINTAINING AN INFANT IN A SUPINE POSITION, which is hereby incorporated by reference in its entirety.

BACKGROUND

It is well documented that swaddling helps an infant fall asleep and remain asleep. It is also well documented that maintaining a sleeping infant in a supine position lowers the risk of sudden infant death syndrome (SIDS).

Conventional swaddles rely on proper wrapping techniques to sufficiently bind the limbs and maintain gentle pressure across the chest and abdomen. A swaddle that is wrapped too tightly may hamper normal breathing and may put an infant at risk of overheating. A swaddle that is improperly wrapped may also loosen over time as the infant becomes restless, allowing the limbs to be freed and portions of the swaddle to migrate over the face, putting the infant at risk of suffocation.

Conventional restraints for maintaining an infant in a supine position rely on attachments that are prone to failure. Attachments that release unintentionally when the infant moves allow the infant to assume a sleeping position other than supine, for instance prone, putting the infant at risk of suffocation.

Therefore, what is needed is a solution for ensuring that an infant maintains swaddled and in a supine position, as well as a constraint solution adaptable to different sleep locations.

BRIEF SUMMARY OF THE INVENTION

According to one aspect, the inventive concepts according to the present disclosure are directed to a system for maintaining an infant in a supine position. In embodiments, the system includes a rigid or semi-rigid base, a fitted cover substantially encasing the rigid or semi-rigid base and including spaced first and second tethers attached to a top of the fitted cover, and a garment including spaced first and second tabs attached to lateral sides of the garment, for instance a swaddle. In use, to secure the garment in place atop the fitted cover, the garment is positioned on top of the fitted cover between the first and second tethers, and the first and second tabs are removably attached to the respective first and second tethers.

In some embodiments, each tether includes a first portion attached to the top of the fitted cover, the first portion including a hook fastener positioned between spaced loop fasteners, and a second portion hingedly attached to the first portion or to the fitted cover, the second portion including a hook fastener, and the second portion movable relative to the first portion between a first position removably attached to the first portion and a second position detached from the first portion.

In some embodiments, each tab includes loop fasteners positioned on opposing sides of the tab, and in use to secure each tab to a respective tether, the hook fasteners of the tether are removably attached to the loop fastener of the tab such that the tab is secured between the first and second portions of the tether.

In some embodiments, a length of the tab substantially corresponds to a length of the hook fastener of the first portion.

In some embodiments, the first and second tabs are positioned above the hips of a restrained (e.g., swaddled) infant so as not to constrain hip motion.

In some embodiments, the first and second tethers are positioned inward of the lateral sides of the fitted cover, and inward of the opposing ends of the fitted cover.

In some embodiments, the fitted cover is a fitted sheet having, on a bottom side thereof, an elastic band extending across an opening formed on the bottom side of the fitted sheet.

In some embodiments, the base is a mattress, a wood or composite (e.g., fiber composite, plastic, etc.) board, a bi-fold wood or composite board, or a tri-fold wood or composite board.

In another aspect, the inventive concepts according to the present disclosure are directed to a system for maintaining a person in a predefined position such as laying or sitting. In embodiments, the system includes a garment configured to be worn by the person and including first and second tabs positioned on opposing lateral sides of the garment, and a base configured to by laid or sat on by the person and including spaced first and second tethers attached to the top of the base. In use to secure the garment on the base, the garment is positioned on the base between the first and second tethers, and the first and second tabs are removably attached to the respective first and second tethers.

In some embodiments, each tether includes a first portion attached to the top of the base, the first portion including a hook fastener positioned between spaced loop fasteners, and a second portion hingedly attached to the first portion or to the base, the second portion including a hook fastener, and the second portion movable relative to the first portion between a first position removably attached to the first portion and a second position detached from the first portion.

In some embodiments, each tab includes loop fasteners positioned on opposing sides of the tab, and in use to secure each tab to a respective tether, the hook fasteners of the tether are removably attached to the loop fastener of the tab such that the tab is secured between the first and second portions of the tether.

In some embodiments, the base is a mattress, a fitted cover, a table, a board, or a chair.

In a further aspect, the inventive concepts according to the present disclosure are directed to a system for maintaining an infant in a supine position. In embodiments, the system includes a garment configured to be worn by the infant and including first and second tabs attached to opposing lateral sides of the garment, and a base configured to be laid on by the infant in a supine position, the base including first and second tethers attached to a top of the base configured to removably attach to the respective first and second tabs to secure the garment to the base.

In some embodiments, each tab includes a first side including a first fastener and a second side including a second fastener, and each tether includes a first portion including a first fastener and a second portion including a second fastener, the second portion movable relative to the first portion. In use to secure each tab to a respective tether, the tab is positioned between the first and second portions of the tether, the first fastener of the tab is removably attached to the first fastener of the tether, and the second fastener of the tab is removably attached to the second fastener of the tether.

In some embodiments, each of the first fastener and the second fastener of the tab is a loop fastener, and each of the first fastener and the second fastener of the tether is a hook fastener.

In some embodiments, for each tether, the first portion is attached to the base, and the second portion is hingedly attached to the first portion.

In some embodiments, in a removably attached condition of the garment atop the base, the garment is positioned between the first and second tethers.

In some embodiments, the base is a sheet, a mattress, a wood or composite board, a bi-fold wood or composite board, or a tri-fold wood or composite board.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
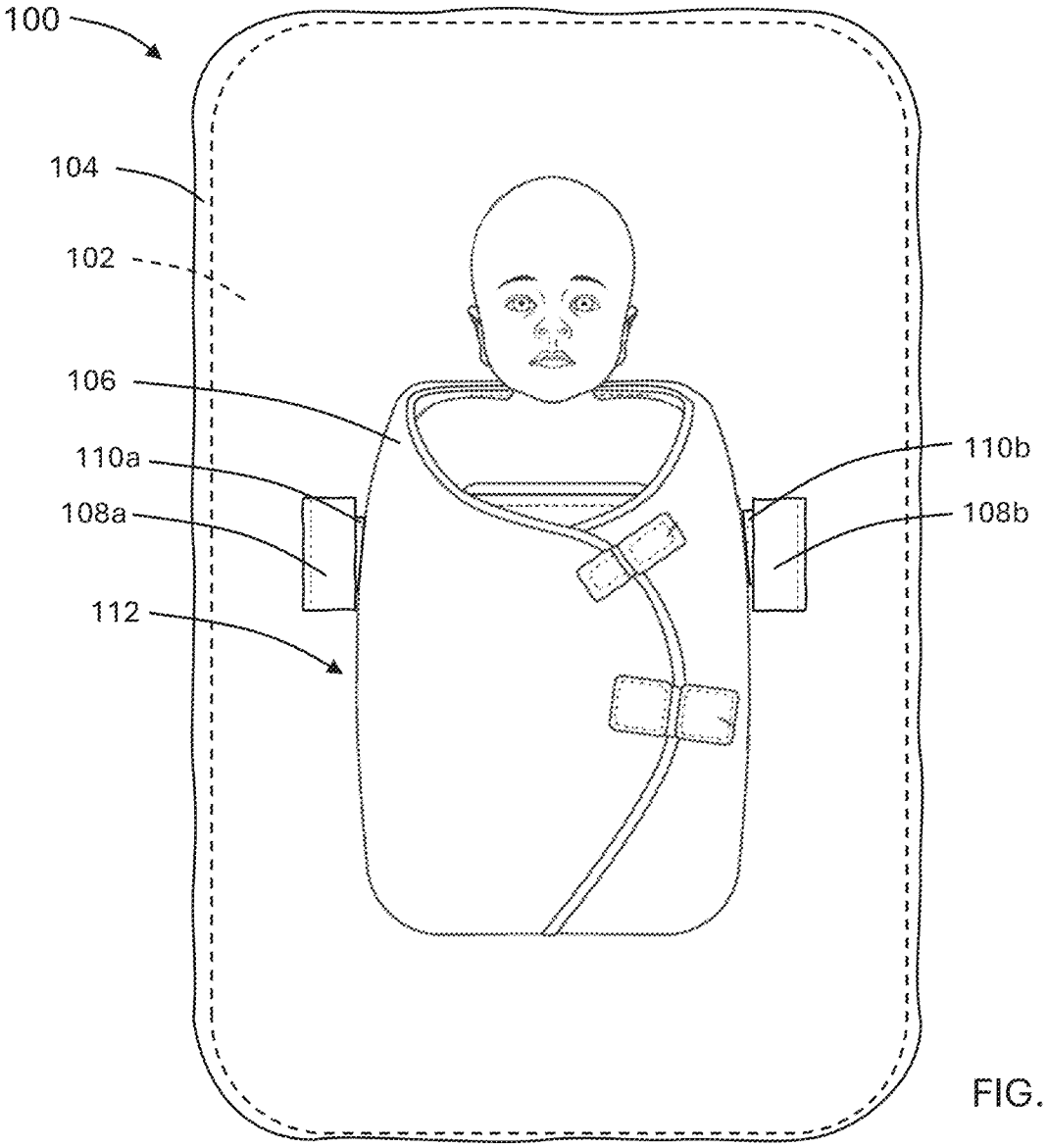
FIG. 1 illustrates a system, in use, for maintaining an infant in a supine position, in accordance with an embodiment of the present disclosure.

Before explaining aspects the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination or sub-combination of two or more such features, along with any other features which may not necessarily be expressly described or inherently present in the instant disclosure.

Broadly speaking, embodiments of the inventive concepts disclosed herein are directed to garments including first fasteners for removable attachment to a base including second fasteners. In use, the garment is worn by a user and the first and second fasteners removably attach to maintain the user in position relative to the base. In some embodiments, the garment may be a swaddle, robe, dress, 'onesie' or other garment type worn by an infant, wherein the first and second fasteners function to maintain the infant in a supine position on the base. In some embodiments, the garment may be worn by a person, wherein the first and second fasteners function to maintain the person in a predefined laying or sitting position relative to the base. In some embodiments, the base may be a rigid base, a fitted sheet, a mattress, a car seat, a blanket, etc.

The systems disclosed herein function to constrain motion. In some embodiments, the system includes a rigid or semi-rigid base, a fitted for being fitted on the base, and a garment for being removably attached to the fitted cover. In use, the garment is worn by an infant and the motion constrained is rollover motion. In use, the base may be moved between different locations such as a crib, a bassinet, a pack-and-play, and a floor. In some embodiments, the systems function to maintain the user removably attached to the base, for instance a bed, a chair, a car seat, etc.

FIG. 1 illustrates a system 100 according to the present disclosure. As shown, the system 100 is configured to maintain an infant in a supine position. The system 100 includes a base 102. The base 102 may be a rigid or semi-rigid substrate, for instance a board, a mattress, a cushion, a foldable platform, etc. The base 102 may be movable between different locations, for instance a crib, a bassinet, a bed, a pack-and-play, etc. The system 100 further includes a fitted cover 104 configured to substantially encase the base 102. The system 100 further includes a garment 106 configured to be removably attached to the fitted cover 104. As shown, the garment 106 is a swaddle. Other garments may include, but are not limited to, blankets, robes, onesies, shirts, and dresses.

The fitted cover 104 includes spaced first and second tethers 108*a*, 108*b* attached to the top of the fitted cover. In some embodiments, the fitted cover 104 is a fitted sheet. Each tether 108*a*, 108*b* may be positioned inward of its respective lateral side of the fitted cover 104 and inward of the opposing ends of the fitted cover 104. In these positions, the tethers 108*a*, 108*b* are used to generally center the infant on the fitted cover 104, away from both the lateral sides and the opposing ends of the fitted cover 104. The garment includes spaced first and second tabs 110*a*, 110*b*. In use, the first tab 110*a* is configured to removably attach or secure to the first tether 108*a*, and the second tab 110*b* is configured to removably attach or secure to the second tether 110*b*. The configurations of the tethers 108*a*, 108*b* and tabs 110*a*, 110*b* are discussed in detail below.

In use to secure the infant in place atop the fitted cover 104, the swaddled infant is positioned between the spaced tethers 108*a*, 108*b*, the first tab 110*a* is attached to the first tether 108*a*, and the second tab 110*b* is attached to the second tether 108*b*. The first and second tabs 110*a*, 110*b* are positioned on the lateral sides of the garment 106 to align and engage with the respective first and second tethers 108*a*, 108*b*. When both tabs 110*a*, 110*b* are secured by the tethers 108*a*, 108*b*, rollover motion is constrained, and the infant is maintained in a supine position. Reference numeral 112 points to the general hip region of the infant. As shown, the tether attachments are positioned 'above' the hip region 112 such that the attachments do not constrain hip and/or leg motion.

Figure 2:
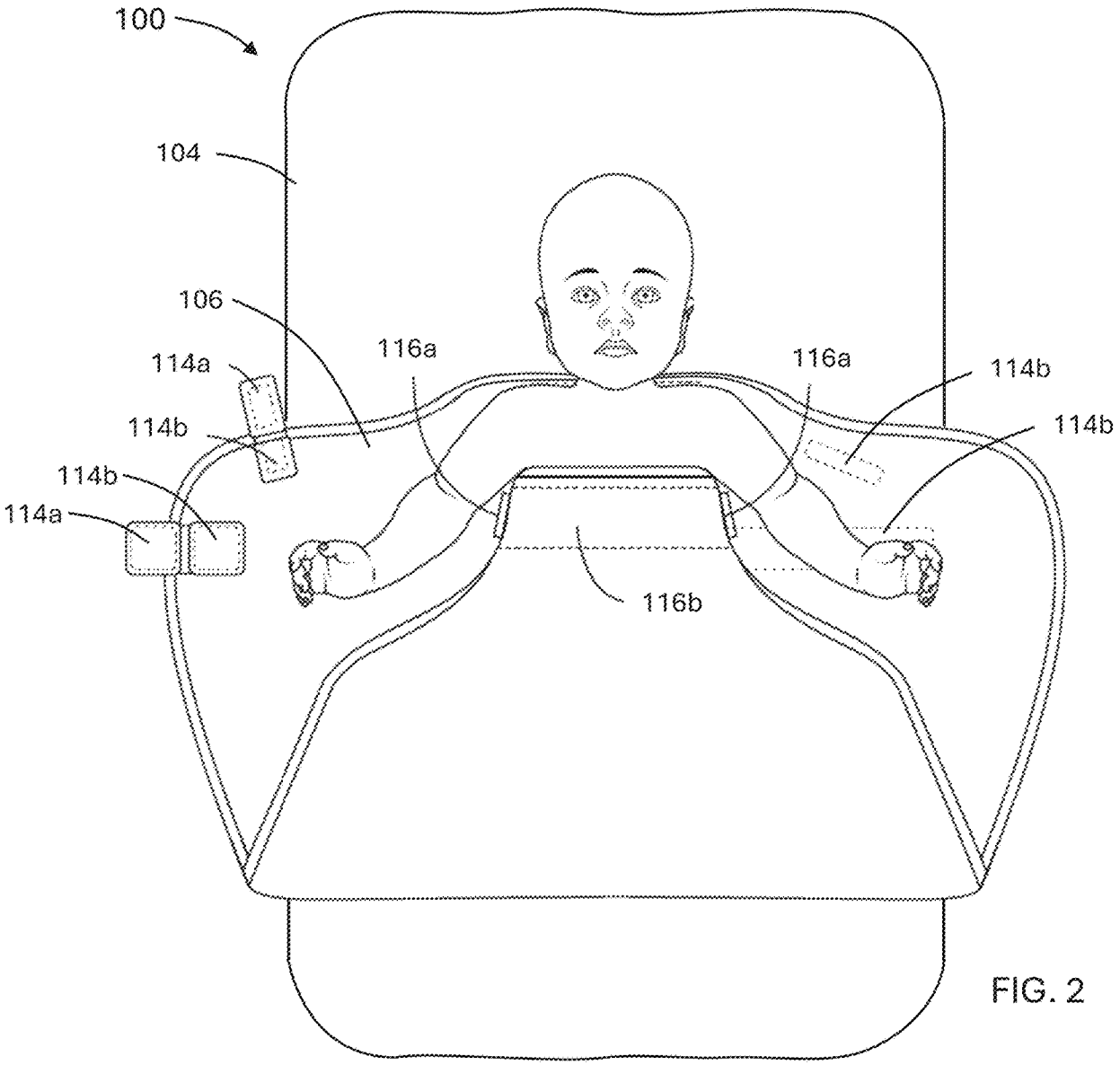
FIG. 2 illustrates the system showing the swaddle in an unfolded condition, in accordance with an embodiment of the present disclosure.

FIG. 2 illustrates the system of FIG. 1 with the garment 106 shown in an unfolded condition. In a non-limiting example, the garment 106 is a swaddle including hook-and-loop flap fasteners that releasably attach to maintain the swaddle in a closed condition. In some embodiments, flap fasteners function to maintain swaddle flaps in a folded condition and include hook elements 114*a* and loop elements 114*b*, wherein the hook elements 114*a* releasably engage the loop elements 114*b*. Loop elements 114*b* may be positioned adjacent to the hook elements 114*a* to 'close' the fasteners during laundering, and additional loop elements 114*b* may be positioned on the back of the opposing flap to secure one folded flap to the other folded flap to maintain a folded over condition. Further flap fasteners are provided in connection with the lower flap which is folded upward and secured in the folded condition around the infant. In some embodiments, the lower flap fasteners include hook fasteners 116*a* for releasably engaging loop fasteners 116*b*. The loop fastener 116*b* may be implemented as a strip of loop material to provide adjustability. In use, the lower flap may be folded upward and secured around the torso and under the arms to prevent downward migration into the swaddle. In use, the swaddle may be attached to the fitted cover 104 and then the infant swaddled, or the infant swaddled and then secured atop the fitted cover 104.

Figure 3:
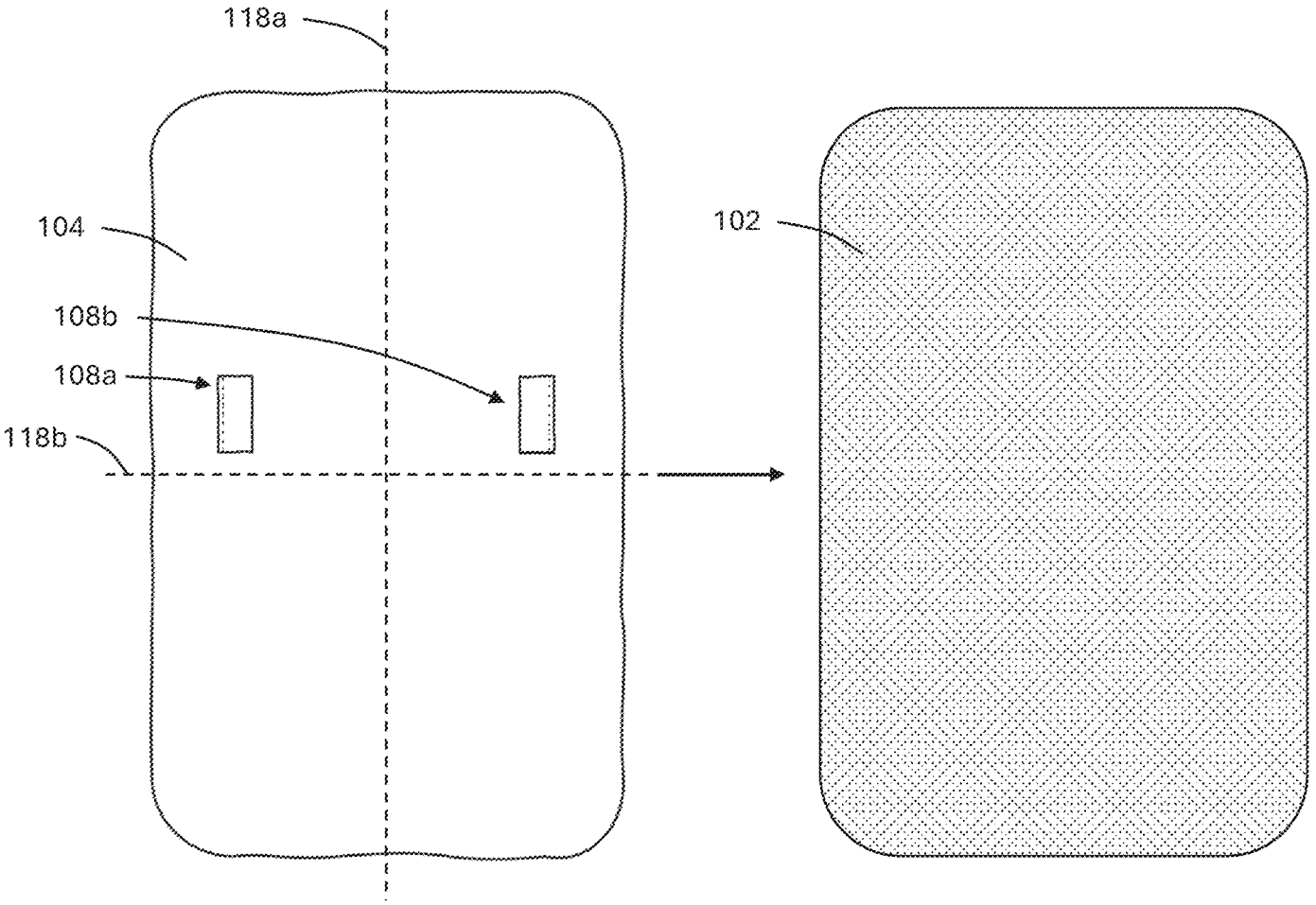
FIG. 3 illustrates a fitted cover for substantially encasing a base of the system, in accordance with an embodiment of the present disclosure.

FIG. 3 illustrates the base 102 and the fitted cover 104 for substantially encasing the base 102, for instance a mattress. An imaginary line 118*a* indicates the longitudinal centerline of the fitted cover 104, and an imaginary line 118*b* indicates the lateral centerline of the fitted cover 104, to show the relative positions of the first and second tethers 108*a*, 108*b* above the hips of the infant when positioned on the fitted cover 104. In this particular conceived example, the spacing between the first and second tethers 108*a*, 108*b* substantially corresponds to the width of the infant. Different spacing may be used to accommodate different sized infants and persons.

Figure 4A:
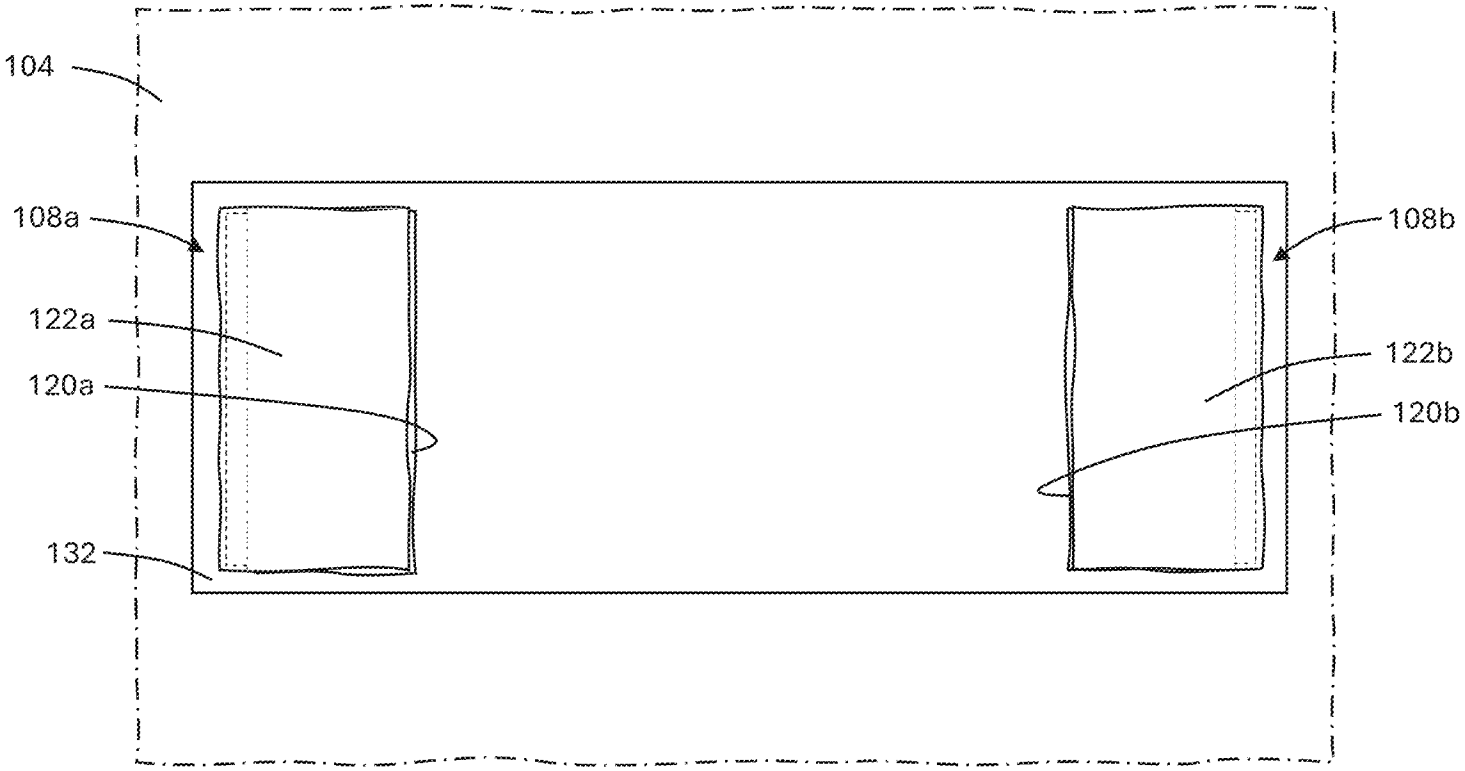
FIG. 4A is a fragmentary view of the fitted cover showing spaced first and second tethers in a closed condition, in accordance with an embodiment of the present disclosure.

FIG. 4A illustrates a portion of the fitted cover 104 including the first and second tethers 108*a*, 108*b* each shown in a 'closed' condition. Each respective tether 108*a*, 108*b*, includes a first portion 120*a*, 120*b* attached to the fitted cover 104, and a second portion 122*a*, 122*b* hingedly attached to the first portion 120*a*, 120*b* or directly to the fitted cover 104. The portions may be sewn to the fitted cover 104 or otherwise attached. In some embodiments, the tethers 108*a*, 108*b* may be sewn to a reinforcing layer 132, positioned above or below the top of the cover, the reinforcing layer 132 providing further resistance against tearing/removal of the tethers 108*a*, 108*b*. In embodiments, the reinforcing layer 132 may extend across a portion of the width of the fitted cover, for instance continuously from tether 108*a* to tether 108*b*. In embodiments, the reinforcing layer 132 may be made from a low-stretch or no stretch material (e.g., stretch resistant), for instance a suede/polyester blend, one or more layers of pre-shrunk flannel, etc., such that the first and second tethers 108*a*, 108*b* maintain a substantially constant maximal spacing. For example, in the case of a stretchable fitted cover 104, the reinforcing layer 132, which may be implemented as a band, resists stretch at the location of the tethers 108*a*, 108*b* such that the distance between the tethers cannot be appreciably increased which may allow some degree of rollover motion. Elements may be sewn to fitted cover 104 and to each other preferably reinforced with double stitching to prevent detachment. In some embodiments, the first portions 120*a*, 120*b* and the second portions 122*a*, 122*b* may be hingedly attached, separately or together, to the fitted cover 104.

Figure 4B:
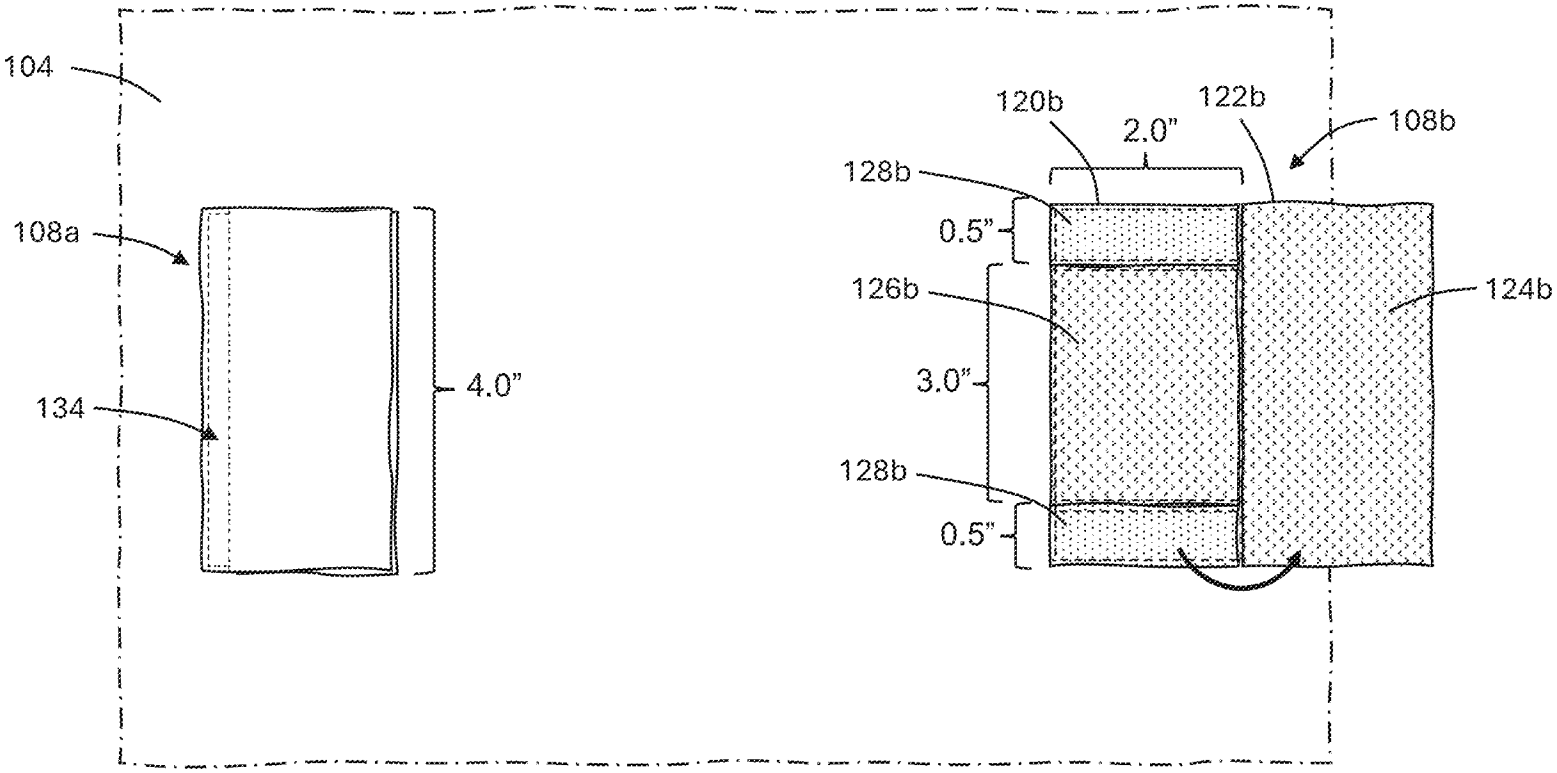
FIG. 4B is a fragmentary view of the fitted cover showing one of the first and second tethers in an open condition, in accordance with an embodiment of the present disclosure.

FIG. 4B illustrates the first and second tethers 108*a*, 108*b*, wherein the first tether 108*a* is shown in the 'closed' condition, and the second tether 108*b* is shown in an 'open' condition for comparison. With reference to the second tether 108*b* shown in the 'open' condition, in some embodiments, the second portion 122*b* includes a hook fastener 124*b* (i.e., a hook component of a hook-and-loop fastener system), and the 'outward/upward' facing side of the first portion 120*b* includes a hook fastener 126*b* positioned between two spaced apart loop fasteners 128*b* (i.e., loop components of a hook-and-loop fastener system. In this configuration, when the tether 108*b* is in the 'closed' condition, the hook fastener 124*b* of the second portion 122*b* removably attaches to the spaced loop portions 128*b* of the first portion 120*b* to maintain the tether closed. This allows the tether to remain closed between uses of the tether, such as during laundering or when the infant is playing on the fitted cover 104 but not attached thereto. By providing a closeable tether, the hook components that can be rough on the skin are covered.

FIG. 4B further illustrates non-limiting dimensions of the first and second tethers 108*a*, 108*b*. For example, each tether 108*a*, 108*b* may have an overall length of about 4 inches and an overall width of about 2 inches. Other dimensions are envisioned. In the case of the second portions 122*a*, 122*b*, the center hook portion 126*b* may have a length of about 3 inches while each loop portion 128*b* may have a length of about 0.5 inches to provide the overall dimension of about 4". These non-limiting dimensions provide enough surface area contact between the hooks and the loops to prevent unintentional opening.

Figure 4C:
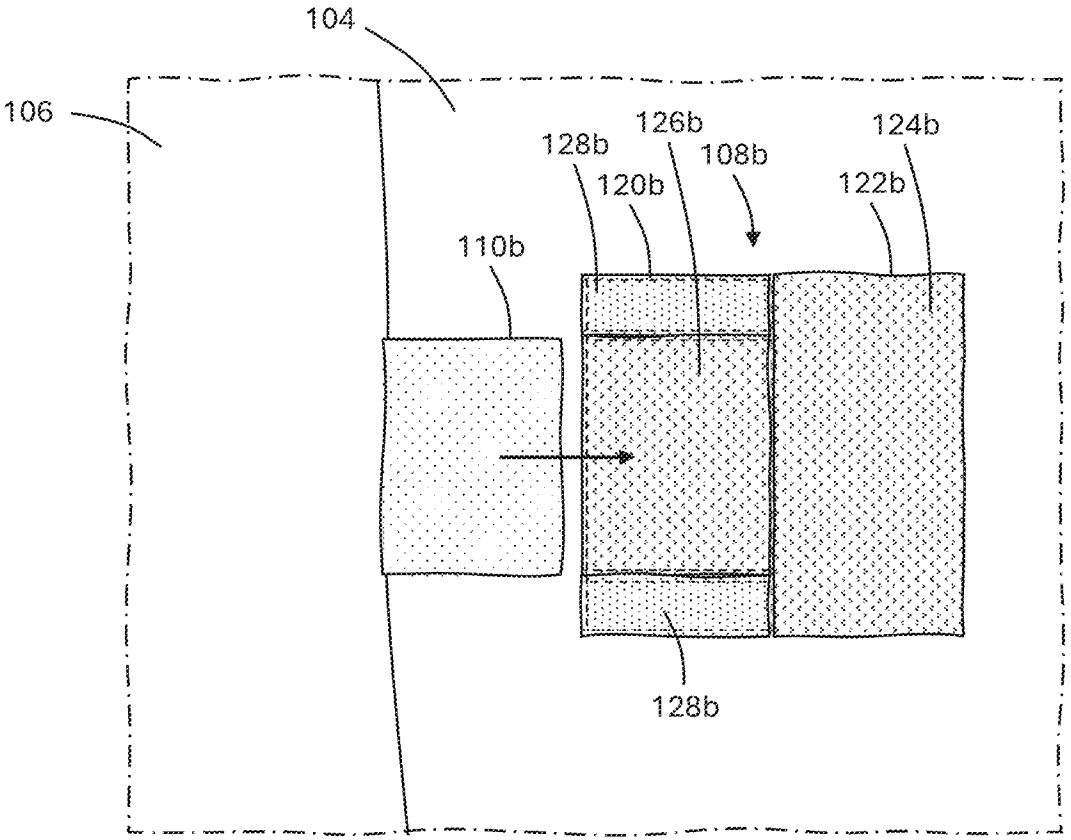
FIG. 4C is a fragmentary view of the fitted cover showing a tab to be removably attached to a tether, in accordance with an embodiment of the present disclosure.
Figure 4D:
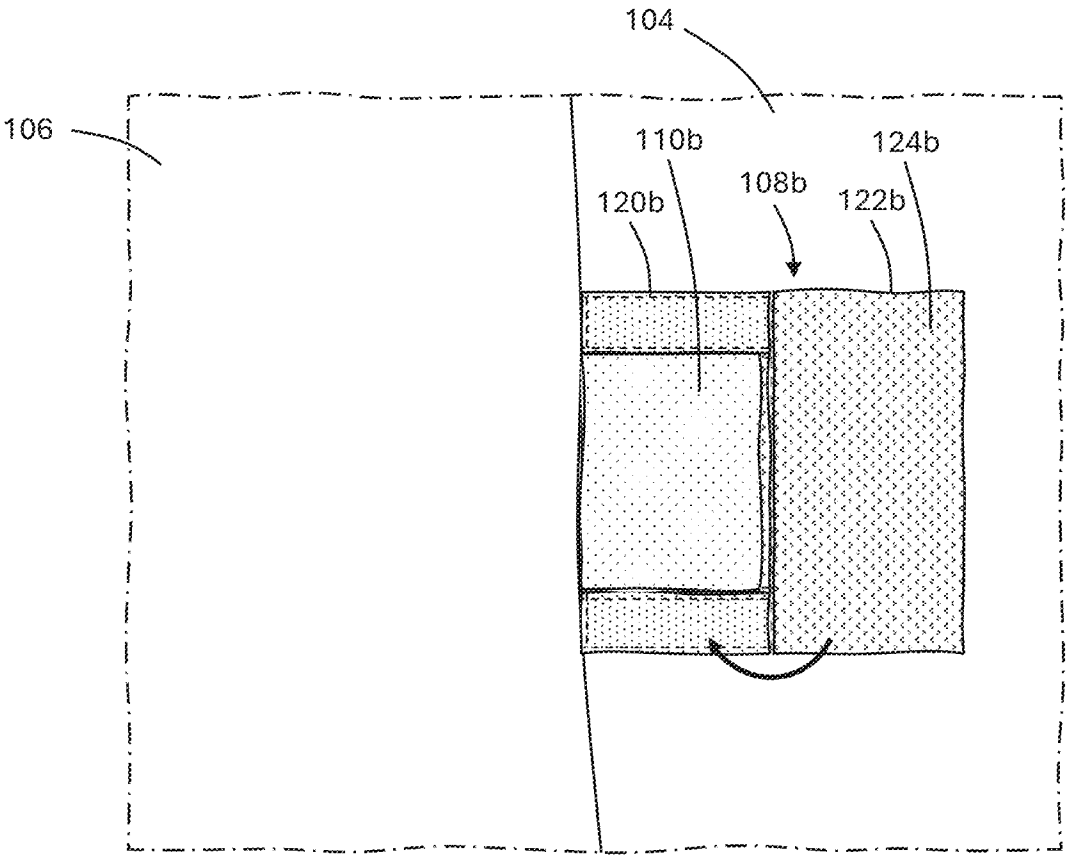
FIG. 4D is a fragmentary view of the fitted cover showing the tab partially attached to the tether, in accordance with an embodiment of the present disclosure.
Figure 4E:
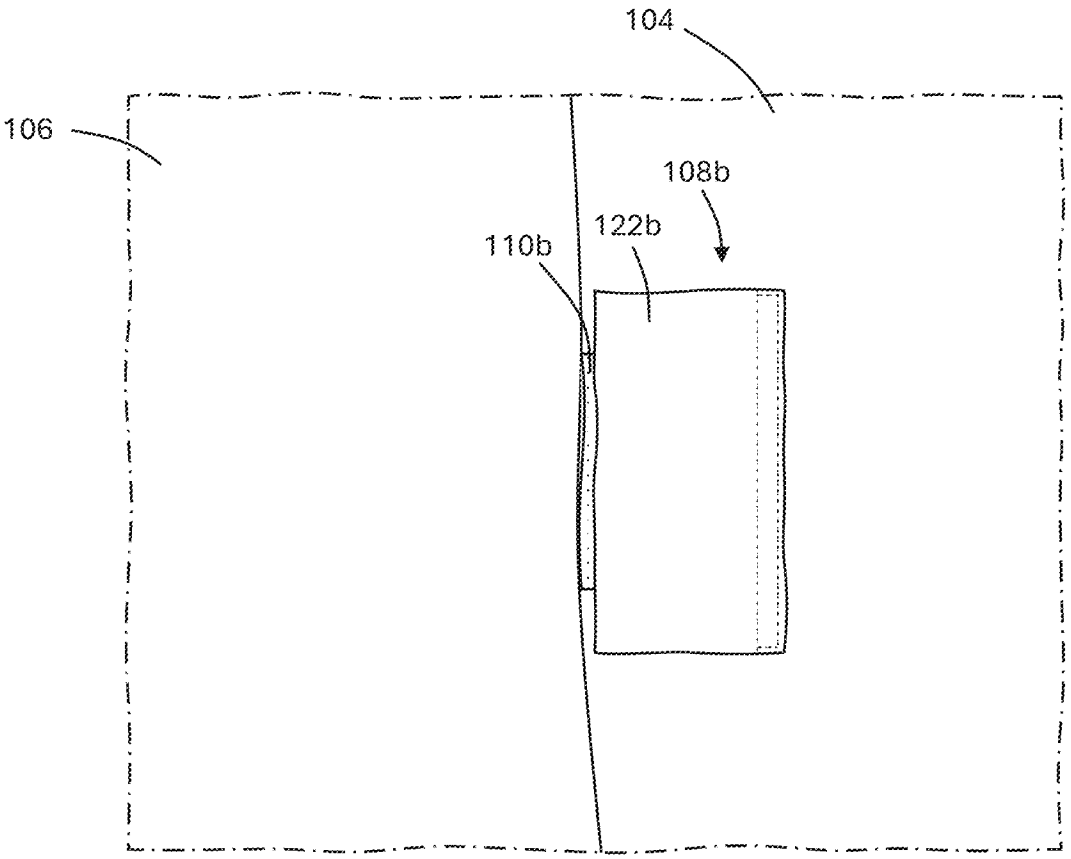
FIG. 4E is a fragmentary view of the fitted cover showing the tab fully removably attached to the tether, in accordance with an embodiment of the present disclosure.

FIGS. 4C-4E illustrate the sequential attachment of one of the tabs to one of the tethers, and by example, attachment of the second tab 110*b* to the second tether 108*b*. The second tab 110*b* is attached to the lateral side of the garment 106 and extends laterally away from the garment 106. The tab 110*b* includes loop fastener on the opposing sides (i.e., double sided) of the tab 110*b* for removably attaching one side of the tab 110*b* to the hook fastener 126*b* of the first portion 120*b*, and the opposing side of the tab 110*b* to the hook fastener 124*b* of the second portion 122*b*. The tab 110*b* is thus positioned and attached between the two portions 120*b*, 122*b* to provide secure attachment. As shown in FIG. 4C, the length of the tab 110*b* substantially corresponds to the length of the hook fastener 126*b* of the first portion 120*b* to provide a guide to the user of how to center and position the tab 110*b* for attachment to the first portion 120*b* (i.e., between the two loop portions 128*b*). FIG. 4C illustrates the tab 110*b* being positioned for attachment to the first portion 120*b* of the second tether 108*b*. FIG. 4D illustrates the second tab 110*b* attached on one side to the first portion 120*b* of the second tether 108*b* and with the second portion 122*b* hinged open. FIG. 4E illustrates the second portion 122*b* folded to close the second tether 108*b* to secure the tab 110*b* between the first and second portions 120*b*, 122*b*. The first tab 110*a* and first tether 108*a* removably attach the same way as the second tab 110*b* and the second tether 108*b*, in no particular order.

In the embodiment described above, the first and second tabs 110*a*, 110*b* include the loop element of the fastener while the first and second tethers 108*a*, 108*b* include the hook element of the fastener. While this arrangement may be preferred to position the 'softer' of the elements out of contact with the infant, the reverse configuration may be practiced. In addition, alternative fasteners for removable attachment may be practiced such as buttons, snaps, and zippers.

Figure 5B:
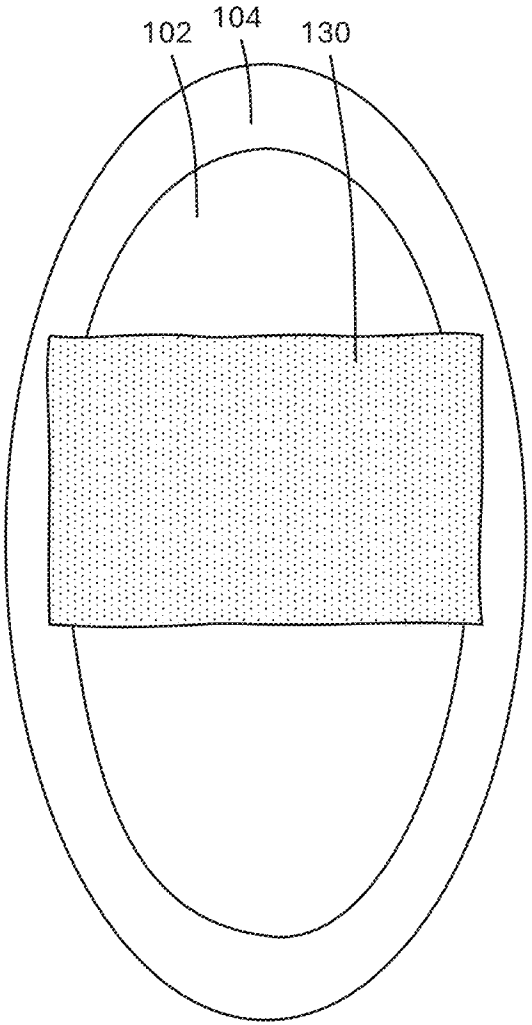
FIGS. 5A and 5B are bottom views of the fitted cover illustrating elastic bands spanning across the bottom opening of the fitted cover, in accordance with embodiments of the present disclosure.
Figure 5A:
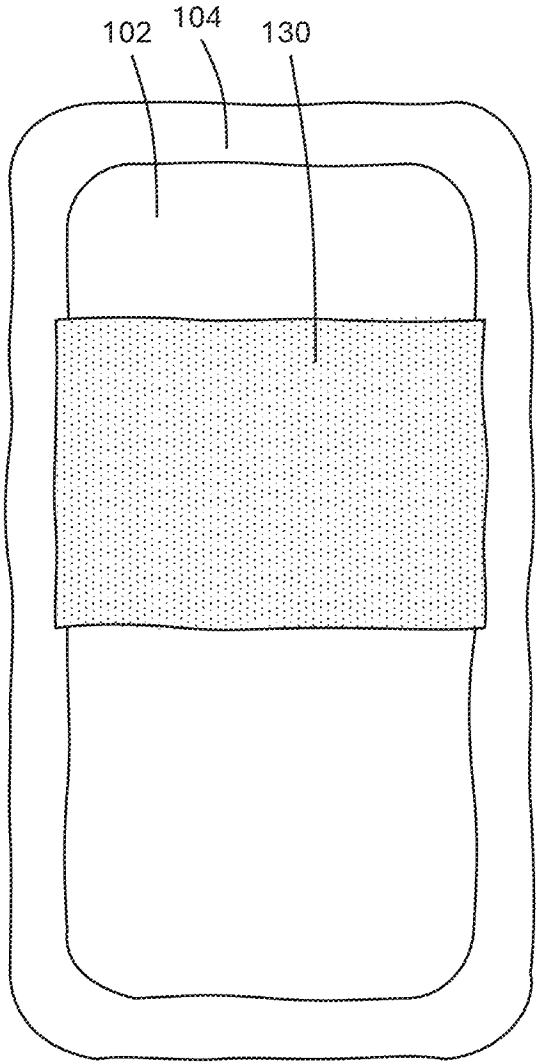

FIGS. 5A and 5B show alternative shapes for the base 102 and fitted covers 104 including elastic banding 130 extending across the bottom opening for preventing the fitted cover 104 from being pulled off the base 102 from movement by the infant or user. For example, without the elastic banding 130, rollover motion may cause the attached tether to pull one side of the fitted cover 104 thereby causing the fitted cover to separate from the base which would allow the infant to complete a rollover motion which would defeat the purpose of the present system.

From the above description, it is clear that the present disclosure disclosed herein is well adapted to achieve the objectives and to attain the advantages mentioned herein as well as those inherent in the present disclosure disclosed herein. While example embodiments of the present disclosure disclosed herein has been described for purposes of this disclosure, it will be understood that numerous changes may be made which will readily suggest themselves to those skilled in the art and which are accomplished within the broad scope and coverage of the present disclosure disclosed and claimed herein.

What is claimed is:

1. A system for maintaining an infant in a supine position, comprising:

a rigid or semi-rigid base;

a fitted cover substantially encasing the rigid or semi-rigid base, the fitted cover including spaced first and second tethers attached to a top of the fitted cover; and a garment including spaced first and second tabs attached to lateral sides of the garment;

wherein, in use to secure the garment in place atop the fitted cover, the garment is positioned on the top of the fitted cover between the first and second tethers, and the first and second tabs are removably attached to the respective first and second tethers, and wherein each tether comprises a first portion attached to the top of the fitted cover and including a hook fastener positioned between spaced loop fasteners, and a second portion hingedly attached to the first portion or to the fitted cover, the second portion including a hook fastener, and the second portion movable relative to the first portion between a first position removably attached to the first portion and a second position detached from the first portion.

2. The system according to claim 1, wherein:

each tab comprises loop fasteners positioned on opposing sides of the tab; and in use to secure each tab to a respective tether, the hook fasteners of the tether are removably attached to the loop fastener of the tab such that the tab is secured between the first and second portions of the tether.

3. The system according to claim 1, wherein a length of the tab substantially corresponds to a length of the hook fastener of the first portion.

4. The system according to claim 1, wherein the first and second tabs are configured to be positioned above the hips of an infant when wearing the garment.

5. The system according to claim 1, wherein the first and second tethers are positioned inward of the lateral sides of the fitted cover, and inward of the opposing ends of the fitted cover.

6. The system according to claim 1, further comprising a reinforcing layer attached to the fitted cover and extending from the first tether to the second tether, wherein the reinforcing layer is made from a no-stretch or low-stretch material to maintain a substantially constant maximal spacing between the first and second tethers.

7. The system according to claim 1, wherein the base is a mattress, a wood or composite board, a bi-fold wood or composite board, or a tri-fold wood or composite board.

8. A system for maintaining a person in a laying or sitting position, comprising:

a garment configured to be worn by the person, the garment including first and second tabs positioned on opposing lateral sides of the garment;

a base configured to be laid on by the person, the base including spaced first and second tethers attached to a top of the base;

wherein, in use to secure the garment relative to the base, the garment is positioned on the top of the base between the first and second tethers, and the first and second tabs are removably attached to the respective first and second tethers, and wherein each tether comprises a first portion attached to the top of the base and including a hook fastener positioned between spaced loop fasteners, and a second portion hingedly attached to the first portion or to the base, the second portion including a hook fastener, and the second portion movable relative to the first portion between a first position removably attached to the first portion and a second position detached from the first portion.

9. The system according to claim 8, wherein:

each tab comprises loop fasteners positioned on opposing sides of the tab; and in use to secure each tab to a respective tether, the hook fasteners of the tether are removably attached to the loop fastener of the tab such that the tab is secured between the first and second portions of the tether.

10. The system according to claim 8, further comprising a reinforcing layer attached to the base and extending from the first tether to the second tether, wherein the reinforcing layer is made from a no-stretch or low-stretch material to maintain a substantially constant maximal spacing between the first and second tethers.

11. The system according to claim 8, wherein the first and second tethers are positioned inward of the lateral sides of the base, and inward of the opposing ends of the base.

12. The system according to claim 8, wherein the base is a mattress, a fitted sheet, a table, or a board.

13. A system for maintaining an infant in a supine position, comprising:

a garment configured to be worn by the infant, the garment including first and second tabs attached to opposing lateral sides of the garment; and a base configured to be laid on by the infant in a supine position, the base including first and second tethers attached to a top of the base configured to removably attach to the respective first and second tabs of the garment to secure the garment to the base, wherein:

each tab comprises a first side including a first fastener and a second side including a second fastener;

each tether comprises a first portion including a first fastener and a second portion including a second fastener, the second portion movable relative to the first portion; and in use to secure each tab to a respective tether, the tab is positioned between the first and second portions of the tether, the first fastener of the tab is removably attached to the first fastener of the tether, and the second fastener of the tab is removably attached to the second fastener of the tether.

14. The system according to claim 13, wherein:

each of the first fastener and the second fastener of the tab is a loop fastener; and each of the first fastener and the second fastener of the tether is a hook fastener.

15. The system according to claim 13, wherein for each tether, the first portion is attached to the base, and the second portion is hingedly attached to the first portion.

16. The system according to claim 13, further comprising a reinforcing layer attached to the base and extending from the first tether to the second tether, wherein the reinforcing layer is made from a no-stretch or low-stretch material to maintain a substantially constant maximal spacing between the first and second tethers.

17. The system according to claim 13, wherein the base is a sheet, a mattress, a wood or composite board, a bi-fold wood or composite board, or a tri-fold wood or composite board.

* * * * *